United States Patent [19]

Bruning et al.

[11] Patent Number: 5,041,075

[45] Date of Patent: Aug. 20, 1991

[54] CONTINUOUS-OPERATION CENTRIFUGE DRUM FOR CONCENTRATING SUSPENDED SOLIDS

[75] Inventors: Paul Bruning; Ulrich Wrede, both of Oelde, Fed. Rep. of Germany

[73] Assignee: Westfalia Separator AG, Oelde, Fed. Rep. of Germany

[21] Appl. No.: 320,026

[22] Filed: Mar. 7, 1989

[30] Foreign Application Priority Data

Mar. 12, 1988 [DE] Fed. Rep. of Germany ..... 3808300
Apr. 7, 1988 [DE] Fed. Rep. of Germany ..... 3811619

[51] Int. Cl.[5] ..... B04B 13/00
[52] U.S. Cl. ..... 494/4; 494/57
[58] Field of Search ..... 494/2, 56, 57, 4, 70

[56] References Cited

U.S. PATENT DOCUMENTS

| | | | |
|---|---|---|---|
| 1,492,699 | 5/1924 | Rasch | 494/57 |
| 2,174,272 | 9/1939 | Lindgren | 494/57 |
| 3,217,982 | 11/1965 | Wilsmann et al. | 494/57 X |
| 4,149,668 | 4/1979 | Zurbruggen | 494/56 X |
| 4,151,950 | 5/1979 | Gunnewig | 494/2 |

FOREIGN PATENT DOCUMENTS

| | | | |
|---|---|---|---|
| 76595 | 10/1953 | Denmark | 494/56 |
| 213371 | 5/1967 | Switzerland | 494/50 |
| 682872 | 11/1952 | United Kingdom | 494/2 |

*Primary Examiner*—Frankie L. Stinson
*Attorney, Agent, or Firm*—Sprung Horn Kramer & Woods

[57] ABSTRACT

A continuous-operation centrifuge drum for concentrating suspended solids. The concentrated solids are diverted out of an outer solids space through channels into an inner chamber, whence the concentrated solids are continuously extracted. At least one vortical-outflow space is positioned between the channels and the inner chamber, with the points of which the medium enters the channels distributed around the outer demarcation of the outflow space and with the outlet from the outflow space extending from a radially outward region in the outflow space to the inner chamber. A separate vortical-outflow space is associated with each channel. Each outflow space consists of two demarcating surfaces, preferably extending in planes perpendicular to the axis of rotation of the drum, and of a surrounding wall that connects them, and extends radially to a multiple of its axial length. The points at which the medium enters the channels preferably extend in planes through the axis of rotation of the drum and the outlets from the vortical-outflow spaces are positioned away from the wall.

16 Claims, 6 Drawing Sheets

CONTINUOUS-OPERATION CENTRIFUGE DRUM FOR CONCENTRATING SUSPENDED SOLIDS

BACKGROUND OF THE INVENTION

The invention concerns a continuous-operation centrifuge drum for concentrating suspended solids, wherein the concentrated solids are diverted out of an outer solids space through channels into an inner chamber, whence the concentrated solids are continuously extracted, whereby at least one vortical-outflow space is positioned between the channels and the inner chamber, with the points at which the medium enters the channels distributed around the outer demarcation of the outflow space and with the outlet from the outflow space extending from a radially outward region in the outflow space to the inner chamber.

A centrifuge drum of this type is already known from German Patent 3 513 335. The channels open into a vortical-outflow space that is concentric with the axis of rotation. The solids enter the outflow space at a peripheral speed that varies as the result of friction as they flow through the space to an extent that depends on their viscosity. The viscosity-dependent change in the peripheral speed leads to alteration in the output of solids, to the extent that the output of extracted solids is automatically regulated within certain limits.

To attain the aforesaid effect, however, it may be necessary to lengthen the radius of the vortical-outflow spaces, which is very expensive.

SUMMARY OF THE INVENTION

The object of the present invention is to decrease the expense of the vortical-outflow spaces and make them more effective.

The object is attained in accordance with the invention by the improvement wherein a separate vortical-outflow space is associated with each channel, and each outflow space consists of two demarcating surfaces, preferably extending in planes perpendicular to the axis of rotation of the drum, and of a surrounding wall that connects them, and extends radially to a multiple of its axial length, whereby the points at which the medium enters the channels preferably extend in planes through the axis of rotation of the drum and the outlets from the vortical-outflow spaces are positioned away from the wall.

It has, surprisingly, been discovered that the flow of a medium out of vortical-outflow spaces of this type is counteracted by a powerful impedance. This impedance depends on the creation of an outflow vortex of the type known from the bottoms of containers. This outflow vortex is caused by Coriolis forces in the centrifugal field, which are most powerful in planes perpendicular to the axis of rotation of the drum. The more the position of the surfaces that demarcate the vortical-outflow space deviate from these planes, the weaker the vortex.

The structure of the vortex also depends on the viscosity of the medium that flows through the vortical-outflow space. The lower the viscosity of the medium and hence the friction of the liquid against the walls of the outflow space, the more powerful the vortex, and vice versa. The throughput of medium through the vortical-outflow space also increases and decreases with the viscosity at constant flow-generating pressure difference, resulting in self-regulation of the concentration of the medium. The vortical-outflow spaces are small enough to be easily manufactured and to be accommodated in the drum.

The vortical-outflow spaces in one advantageous embodiment are concentric with the axis of rotation of the drum. This measure leaves the center of the drum free, providing enough space for inflow into the drum.

The outlet from each vortical-outflow space in another advantageous embodiment opens into the periphery of a downstream vortical-outflow space, the outlets of which communicate with the inner chambers. Several downstream vortical-outflow spaces can in fact be associated with each upstream space. Since this measure augments the effect of the constriction, the regulating process can be controlled in accordance with the properties of the solids.

The walls of the vortical-outflow spaces can be of any shape. This feature facilitates adaptation to a drum of any design.

Vortical-outflow spaces can be produced especially easily when their walls are elliptical or circular.

The walls of the vortical-outflow spaces can be depressions in one part of the drum and have replaceable heads that accommodate the outlets. The outlets in different replaceable heads can have different diameters. The outlets in different replaceable heads can be at different distances from the points at which the medium enters the channels. This measure facilitates controlling the procedure for regulating the vortical-outflow spaces.

The procedure for regulating the outflow spaces can also be controlled if the heads can be inserted to different depths into the depressions to vary the open height of the vortical-outflow space.

The outlets of the vortical-outflow spaces in another embodiment of the invention open into the periphery of just one downstream vortical-outflow space that is concentric with the axis of rotation and communicates by way of its inner demarcation with the inner chamber. The concentric vortical-outflow space advantageously augments the effect of the vortical-outflow spaces in accordance with the invention.

To ensure satisfactory regulation of the vortical-outflow spaces without varying the outflow cross-section, even when the level of solids fluctuates very widely, a choke that opens in accordance with pressure and viscosity can be associated with every outlet from a vortical-outflow space.

The choke can be a diaphragm of flexible material at the exit from each outlet and having a system of slits that opens automatically and expands the cross-section as the pressure increases. The choke can be a valve cone at the exit from each outlet and a resilient structure that generates tension toward the exit from the outlet can be associated with the cone. The exit from the outlet can extend radially inward and have associated with it a radially moving valve body that functions as a choke subject to centrifugal force.

BRIEF DESCRIPTION OF THE DRAWINGS

Embodiments of the invention will now be described in greater detail with reference to the drawing, wherein.

DETAILED DESCRIPTION OF THE INVENTION

Figure 1:
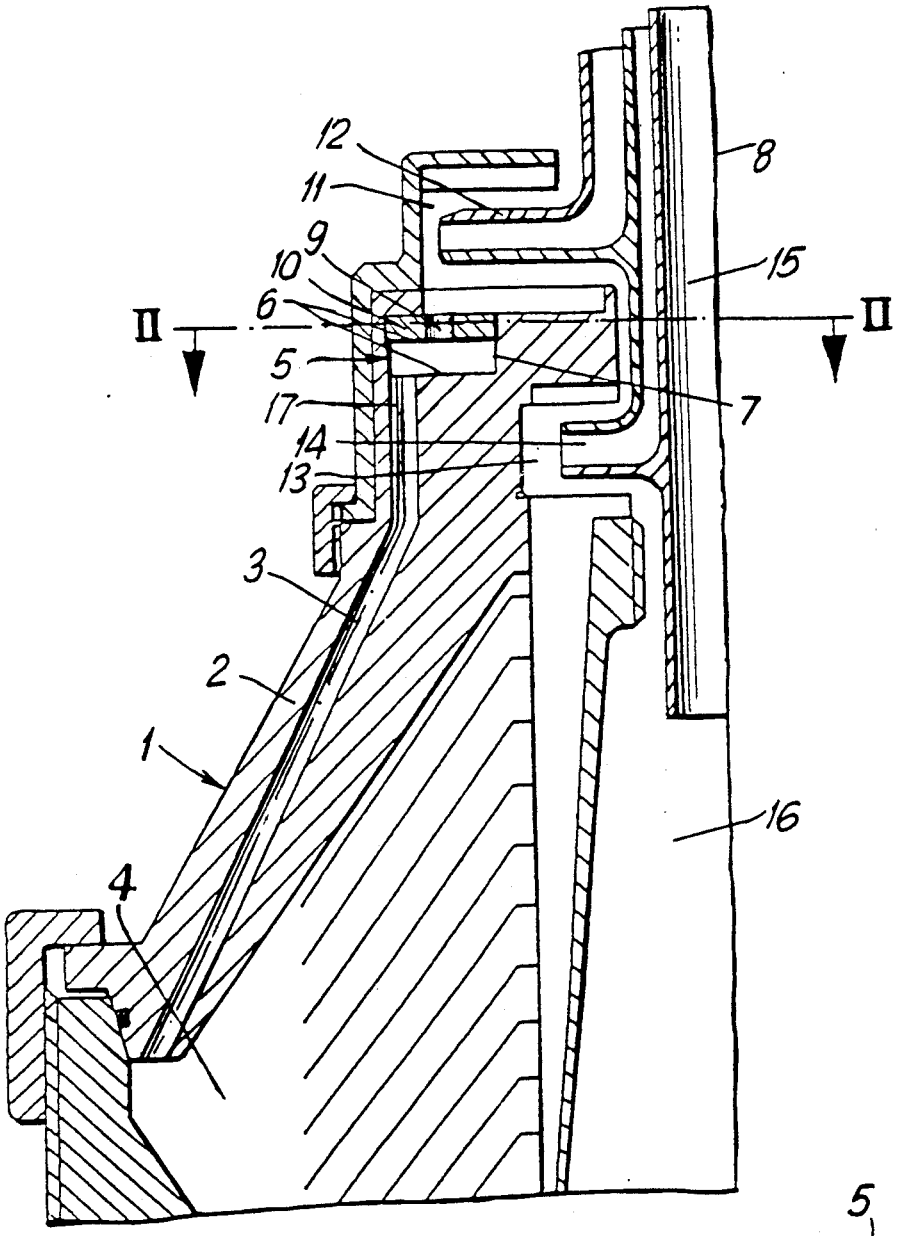
FIG. 1 is a section through part of the centrifuge drum.
Figure 2:
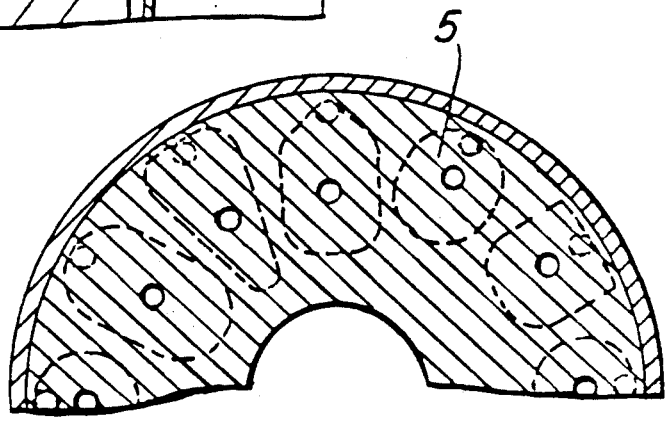
FIG. 2 is a section along the line II—II in FIG. 1.

Referring now to FIGS. 1–2, a centrifuge drum 1 has a lid 2 with channels 3, through which a solids space 4 communicates with vortical-outflow spaces 5. Vortical-outflow spaces 5 are demarcated by surfaces 6, which extend in planes perpendicular to the axis 8 of rotation of the drum, and by a surrounding wall 7 that connects demarcating surfaces 6. Outlets 9, which are accommodated in replaceable heads 10, extend out of vortical-outflow spaces 5 and into an inner chamber 11 that accommodates a skimmer 12. Outlets 9 are far enough away from wall 7 to allow an outflow vortex to form unimpeded. Another skimmer 14, accommodated in a chamber 13, diverts the separated liquid phase. A product intake 15 opens into an inflow space 16. The points 17 at which the medium enters channels 3 open into vortical-outflow spaces 5 in the vicinity of the walls 7.

Centrifugate is supplied through product intake 15 and is clarified in drum 1. The precipitated solids are collected in solids space 4 and diverted into vortical-outflow spaces 5 through channels 3. An outflow vortex becomes established, due to the Coriolis forces that act in the planes perpendicular to the axis of rotation of the drum, in the vicinity of the outlets 9 from vortical-outflow spaces 5 and generates an increased impedance that counteracts the flow of solids out of vortical-outflow spaces 5. The outflow vortex and hence the impedance increases as the viscosity of the solids decreases and vice versa. Thus, when the solids concentrate is less viscous, less solids will be extracted from solids space 4 than when it is more viscous. The solids flowing into inner chamber 11 by way of outlets 9 are forced under pressure through skimmer 12 and out of drum 1.

It will be evident from FIG. 2 that vortical-outflow spaces 5 are concentric with the axis 8 of rotation of drum 1. Although vortical outflow spaces of different shapes are illustrated, they will of course all be the same shape in an actual embodiment.

Figure 3:
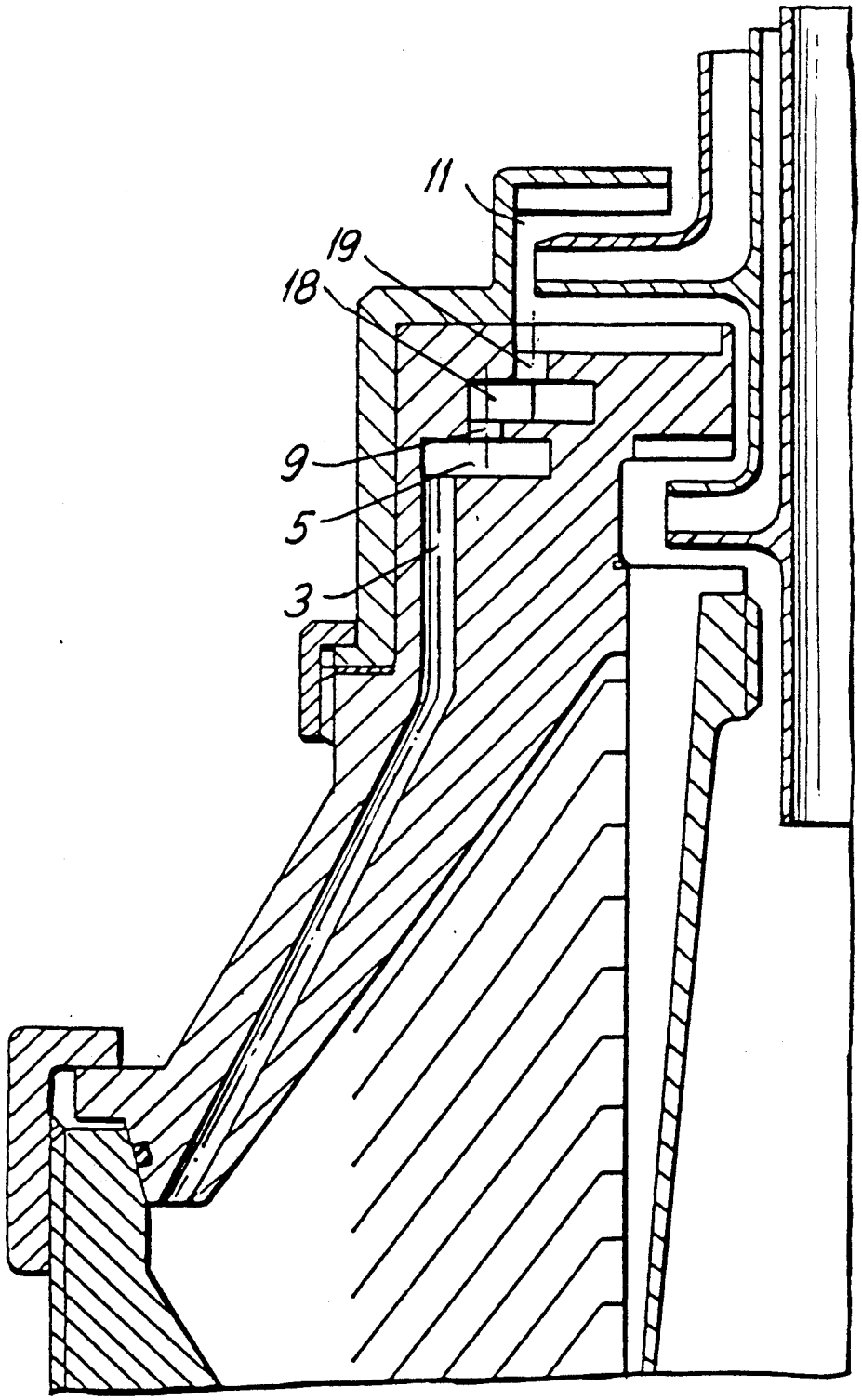
FIG. 3 is a section through part of a drum with upstream and downstream vortical-outflow spaces.

The aforesaid regulating action is augmented in the embodiment illustrated in FIG. 3 in that the outlet 9 from each vortical-outflow space 5 opens into a downstream vortical outflow space 18, which has an outlet 19 that opens into inner chamber 11.

Figure 4:
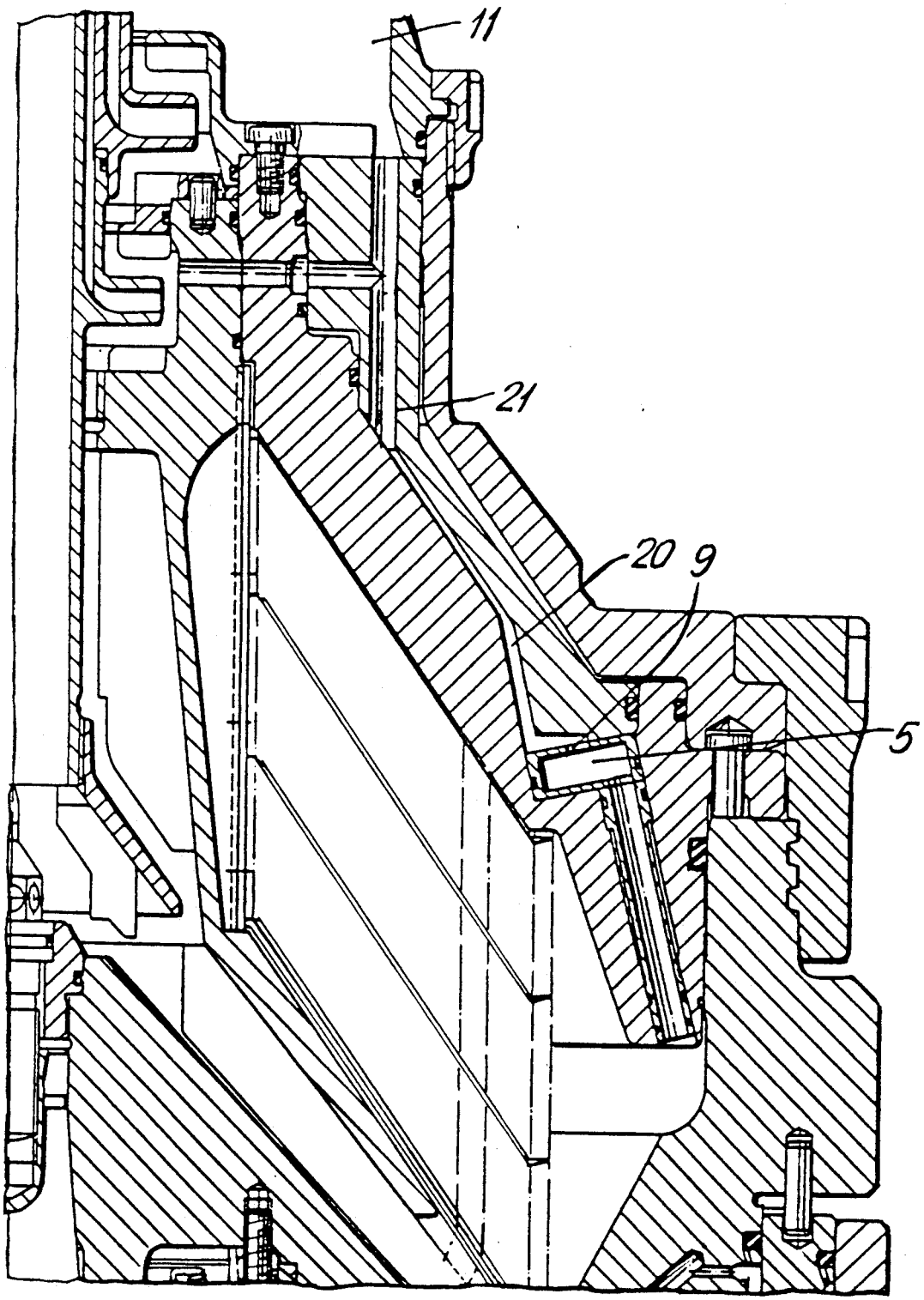
FIG. 4 is a section through part of a drum with a downstream concentric vortical-outflow space.

The action of vortical-outflow spaces 5 is again augmented in the embodiment illustrated in FIG. 4 by a downstream concentric vortical outflow space 20, into which all the outlets 9 from vortical outflow spaces 5 open. Downstream vortical outflow space 20 communicates through its inner demarcation 21 with inner chamber 11.

The procedure for regulating vortical-outflow spaces 5 can be even further augmented when some of the solids concentrate diverted out of centrifuge drum 1 are in a known way returned to solids space 4 or to the points 17 at which the medium enters channels 3.

Figure 5:
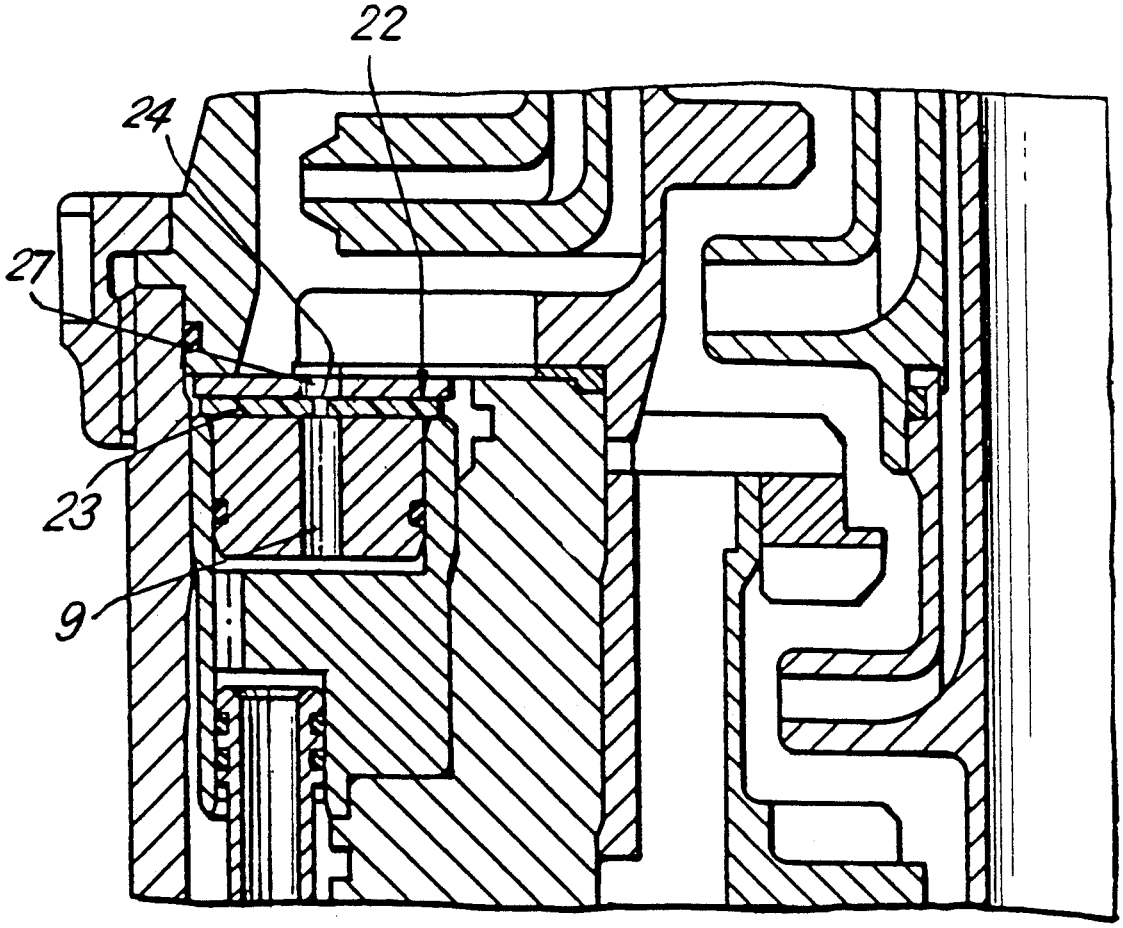
FIG. 5 illustrates a choke in the form of a diaphragm at the outlet of a vortical-outflow space.

Associated with the outlets 9 in the embodiment illustrated in FIG. 5 are chokes 22 consisting of flexible diaphragms 23 that have systems of slits 24 and close off the exits 27 from the outlets. The systems of slits consist of two intersecting incisions in the center of each diaphragm 23. This measure augments the constricting effect of vortical-outflow spaces 5 even further, especially when the throughput is low. The pressure on chokes 22 increases with the viscosity of the volumetric flow of solids an accordingly expands the cross-section released by the systems of slits 24 and hence also the volume of solids flowing through vortical-outflow spaces 5. The regulating characteristic of chokes 22 accordingly acts along the same direction as vortical-outflow spaces 5 themselves. The outlets 9 from vortical-outflow spaces 5 can in this embodiment be large enough to prevent undesired constriction on the part of outlets 9 when the volume of solids is large. When there are less solids, the chokes 22 associated with outlets 9 produce a constriction that augments the effect of the vortex in vortical-outflow spaces 5, improving the regulation of the concentration of solids. When more solids are supplied to the drum, the concentration of the volume of solids flowing through vortical-outflow spaces 5 will initially increase. The viscosity of the volumetric flow of solids will then increase along with the concentration of solids, and the viscosity-dependent reduction of the vortex in vortical-outflow spaces 5 will result in increased pressure on chokes 22. Their cross-sections will expand automatically and allow a greater volume of solids to flow through vortical-outflow spaces 5. Since the constricting action of chokes 22 is considerably less powerful at high throughputs than the constricting action of vortical-outflow spaces 5 themselves, the desired effect will not be impermissibly deteriorated.

Figure 6:
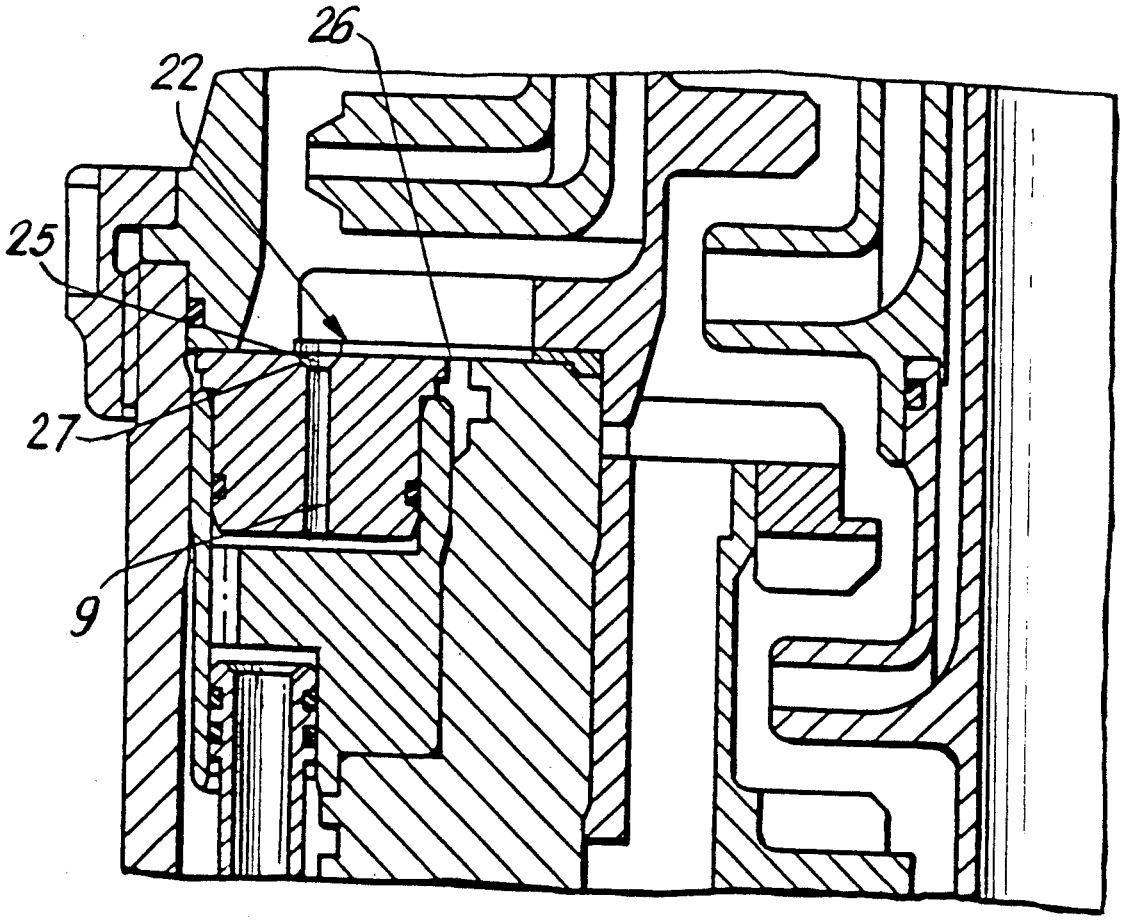
FIG. 6 illustrates a choke in the form of a spring-loaded valve cone at the outlet of a vortical-outflow space.

The choke 22 in the embodiment illustrated in FIG. 6 is a valve cone 25 that is forced by a resilient structure 26 against the exit 27 from outlet 9. As the viscosity of the solids, and hence the associated pressure, increases, valve cone 25 will move up and release more of the outflow cross-section.

Figure 7:
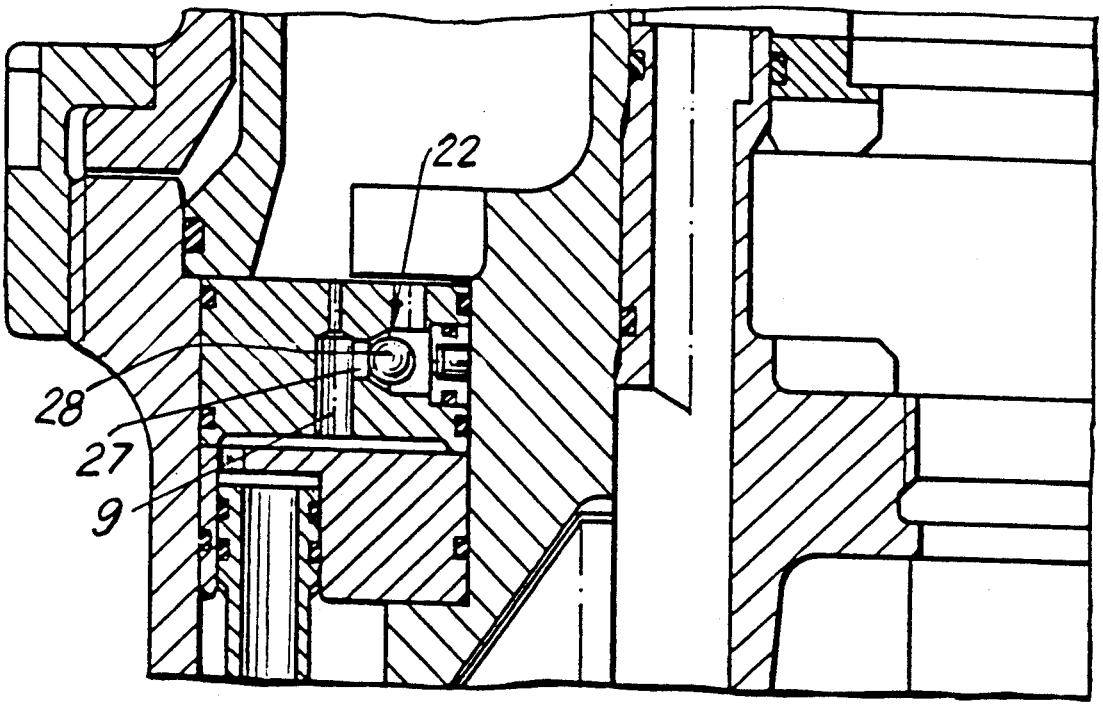
FIG. 7 illustrates a choke in the form of a radially moving valve body at the outlet of a vortical-outflow space that opens subject to centrifugal force.

The exit 27 from the outlet 9 illustrated in FIG. 7 extends inward. The choke 22 is a radially moving valve body 28 in the form of a ball that is forced against exit 27 by centrifugal force. Depending on volume and viscosity, valve body 28 moves radially inward and releases more or less cross-section. The result is a drop in pressure at outlet 9 that depends on the size and specific gravity of valve body 28.

The solution proposed herein requires no nozzles in the channels to attain the desired concentration of solids as in known systems. Only a minimal pressure difference is accordingly needed to force the solids through the vortical-outflow spaces. The power requirements for the drum are accordingly reduced to advantage.

It will be appreciated that the instant specifications and claims are set forth by way of illustration and not limitation, and that various modifications and changes may be made without departing from the spirit and scope of the present invention.

What is claimed is:

1. In a continuous-operation centrifuge drum for concentrating suspended solids, rotatable about an axis and having an outer solids space, an inner chamber, channels for diverting concentrated solids out of the outer solids space into the inner chamber, means for continuously extracting concentrated solids from the drum including a vortical-outflow space positioned between the channels and the inner chamber and wherein the vortical-outflow space has inlets at which medium enters from the channels, said inlets distributed around an outer demarcation of the outflow space and an outlet from the outflow space extending from a radially outward region in the outflow space to the inner chamber, the improvement comprising means forming a vortical-outflow space associated with each channel, comprising two demarcating surfaces, extending in planes perpendicular to the axis of rotation of the drum, and a surrounding wall connecting the two demarcating surfaces and extending radially to a multiple of its axial length, wherein the inlets at which the medium enters from the channels extend in planes through the axis of rotation of the drum and the outlets from the vortical-outflow spaces are positioned away from the surrounding wall.

2. A drum according to claim 1, wherein the vortical-outflow spaces are concentric with the axis of rotation of the drum.

3. A drum according to claim 1, wherein the outlet from each vortical-outflow space opens into the periphery of a downstream vortical-outflow space, the outlets from which communicate with the inner chambers.

4. A drum according to claim 1, wherein several downstream second vortical-outflow spaces are associated with each upstream first vortical-outflow space.

5. A drum according to claim 1, wherein the walls of the vortical-outflow spaces are of any shape.

6. A drum according to claim 1, wherein the walls are elliptical.

7. A drum according to claim 1, wherein the walls are circular.

8. A drum according to claim 1, wherein the walls of the vortical-outflow spaces are depressions in one part of the drum and have replaceable heads that accommodate the outlets.

9. A drum according to claim 8, wherein the outlets in different replaceable heads have different diameters.

10. A drum according to claim 8, wherein the outlets in different replaceable heads are at different distances from the points at which the medium enters the channels.

11. A drum according to claim 8, wherein the heads are inserted to different depths into the depressions to vary the open height of the vortical-outflow space.

12. A drum according to claim 1 wherein the outlets from the vortical-outflow spaces open into the periphery of just one downstream vortical-outflow space that is concentric with the axis of rotation and communicates by way of an inner demarcation surface with the inner chamber.

13. A drum according to claim 1, wherein a choke that opens in accordance with pressure and viscosity is associated with every outlet from a vortical-outflow space.

14. A drum according to claim 13, wherein the choke is a diaphragm of flexible material at an exit from each outlet and having a system of slits that opens automatically and expands the cross-section as the pressure increases.

15. A drum according to claim 13, wherein the choke is a valve cone at an exit from each outlet, and a resilient structure that generates tension toward the exit from the outlet is associated with the cone.

16. A drum according to claim 1, wherein an exit from the outlet extends radially inward and has associated with it a radially moving valve body that functions as a choke subject to centrifugal force.

* * * * *